US005224408A

United States Patent [19]

Steidinger

[11] Patent Number: 5,224,408

[45] Date of Patent: * Jul. 6, 1993

[54] APPARATUS FOR CUTTING

[75] Inventor: Donald J. Steidinger, Barrington, Ill.

[73] Assignee: Tamarack Products, Inc., Barrington, Ill.

[ * ] Notice: The portion of the term of this patent subsequent to Feb. 11, 2009 has been disclaimed.

[21] Appl. No.: 823,963

[22] Filed: Jan. 21, 1992

Related U.S. Application Data

[63] Continuation-in-part of Ser. No. 627,214, Dec. 13, 1990, Pat. No. 5,086,683.

[51] Int. Cl.[5] ..... B26D 1/62

[52] U.S. Cl. ..... 83/674; 83/346; 83/698

[58] Field of Search ..... 83/343, 346, 348, 673, 83/674, 675, 698

[56] References Cited

U.S. PATENT DOCUMENTS

| | | | |
|---|---|---|---|
| 3,793,918 | 2/1974 | Huffman | 83/698 |
| 3,865,164 | 2/1975 | Sybertz | 144/230 |
| 3,989,077 | 11/1976 | Humbert | 144/230 |
| 4,068,694 | 1/1978 | Schmidt et al. | 83/698 |
| 4,143,568 | 3/1979 | Cogswell | 83/116 |
| 4,444,080 | 4/1984 | Schulz | 83/660 |
| 4,475,425 | 10/1984 | Punater | 83/674 |
| 4,594,928 | 6/1986 | Thomas et al. | 83/698 |
| 4,671,154 | 6/1987 | Thomas et al. | 83/698 |
| 4,848,202 | 7/1989 | Crampton | 83/343 |
| 4,920,843 | 5/1990 | Stromberg | 83/346 |
| 5,086,683 | 2/1992 | Steidinger | 83/674 |

*Primary Examiner*—Hien H. Phan

*Attorney, Agent, or Firm*—Tilton, Fallon, Lungmus & Chestnut

[57] ABSTRACT

Apparatus for cutting web material in which blade and anvil rolls cooperate, the blade roll having a slot in which a blade-equipped bar is mounted and equipped with springs for exerting both generally radially outward and generally circumferentially resilient forces on the bar and blade and in which friction means are operably associated with the blade for inhibiting axial movement of the blade.

11 Claims, 3 Drawing Sheets

APPARATUS FOR CUTTING

This application is a continuation-in-part of my copending application Ser. No. 627,214 filed Dec. 13, 1990, now U.S. Pat. No. 5,086,683.

BACKGROUND OF THE INVENTION

This invention relates to apparatus and method for cutting and more particularly the mounting of cutting blades in a rotating cylinder for cutting or perforating continuous webs of paper, plastic, fabric, etc. More specifically, the invention applies to the manner in which the cutting blade is supported, clamped, and changed.

In the manufacture of many articles of paper, plastic, fabric and the like, there is a need to cut or perforate across the width of a moving web. A widely used method of doing this is to use steel rule cutting blades clamped in a slot of a rotating cylinder or roll. The blades cut against a hardened steel impression cylinder or roll. A plurality of cutting rules are mounted around the circumference of the cylinder. The blades are first clamped lightly, the cylinder rotated one revolution to seat each blade in contact with the impression cylinder, then the blades are securely clamped before cutting any paper, plastic, fabric, etc.

This method works quite well and has been in common use for many years. It does have some objections, however. First, as the speed of machinery has increased, a problem developed due to the heat generated in the bearings of the blade and impression cylinders. This heating causes the frames of the machine supporting the cylinders to expand—thus separating the centers of the cylinders and causing poor cutting for lack of sufficient contact between the cutting blade and the impression cylinder. This problem has been solved at some expense by providing heaters for the frames to maintain them at a uniform elevated temperature.

A second problem is the long time it takes to install new blades. The blades are typically held by a series of clamping screws each one of which must be set to a proper torque for the first revolution of the cylinder, and then tightened for the final clamping. If the torque for the first setting is too low, the blades will not cut. If it is too high, the blades will hit too hard giving short blade life and severe wear and tear on the bearings, drive gears, etc. If the blades are extended too far out of the blade cylinder slot for the first revolution, they can be permanently bent, and thus ruined—as a bent blade will not cut cleanly. The difficulty of setting cutting blades by this method results in many blades being set improperly requiring resetting, short blade life or poor quality cuts.

Prior art concerned with the solution of these problems includes U.S. Pat. No. 3,793,918 which discloses a method of clamping along the length of the blade by means of a plurality of cylindrical locking pieces actuated to apply a blade locking pressure by means of a single wedge in order to reduce the lock up time. U.S. Pat. Nos. 3,865,164, 3,989,077 and 4,068,694 show methods of spring loading wedge shaped clamping bars and U.S. Pat. Nos. 4,594,928 and 4,671,154 use pressure cylinders to provide the clamping force. All these patents rigidly clamp the blade and deal only with the problem of reducing the time to change the blades More recently U.S. Pat. Nos. 4,848,202 and 4,902,843 also show method of quick change mounting of blades. U.S. Pat. No. 4,848,202 provides for shimming under the clamping bar to adjust for inaccuracies in machining or tolerances while U.S. Pat. No. 4,920,843 provides for operator adjustment screws for each blade to compensate for these differences in blade height.

U.S. Pat. No. 4,143,568 shows a resilient mounting of the cutting blade so that the blade or its mounting can be flexed to the extent necessary to develop the required cutting force using the spring rate of the blade to avoid the rolling in "process" to adjust the height of the blade. Again this patent addresses only one of the several problems.

U.S. Pat. No. 4,444,080 shows a blade made to be elastically deformable to enable at least a portion of the blade to yield as it engages the hard surface of the impression cylinder. Here the means provided to enable the deformation, require that the blade be clamped along only the lowermost portion of the blade which leaves the cutting edge of the blade poorly supported.

None of the prior art provides a cutting blade support and clamping system that meets the objectives of this invention. In particular, none of the prior art provides restraint to the movement of the blade across the width of the cylinder while clamped with reduced spring force.

SUMMARY OF THE INVENTION

It is an objective of this invention to provide a cutting rule mounting that is not affected by normal blade height tolerances.

Another objective is to provide a mounting that is not adversely affected by changes in cylinder center distances due to heating.

Another objective is to provide a mounting that can accept non-uniform blade contact due to runout in the blade or impression cylinders.

Another objective is to provide a mounting that does not require a first clamping and then a final lock up clamping operation.

Another objective is to provide a mounting that permits fast changing of blades without the use of many clamping screws.

Still another objective is to provide a blade mounting that does not require the high clamping forces necessary in present systems.

Another objective is to provide a blade mounting that does not require operator adjustment to accommodate variations in blade height, thickness, or mounting distance.

A general objective is to provide a blade mounting that permits the operator to change blades using nominal force without special tools, withdrawal devices, etc.

A more specific objective of this invention is to provide a restraint to prevent the blade from "walking", moving across the width of the cylinder during the course of many cutting operations.

A further objective is to provide a positive restraint to fix the blade in the position as installed and, more particularly such a positive restraint using a much reduced force against the blade than is otherwise required.

These objects and advantages are provided in the instant invention through a blade cylinder operating in conjunction with an impression cylinder, the blade roll having an axially extending slot receiving a bar spaced from the slot bottom, the bar being equipped with generally circumferentially extending ledge means at the bottom thereof, a blade mounted on the ledge means and spring means operatively associated with the blade cylinder bearing against the bar and exerting both a radial and a circumferential force thereagainst. Additionally I provide friction means operably associated with the blade to inhibit axial movement thereof.

DETAILED DESCRIPTION

Figure 1:
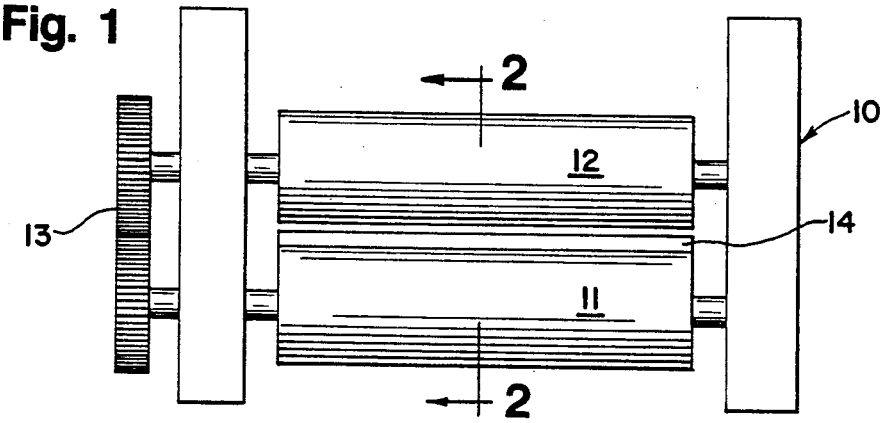
FIG. 1 is an end elevational view of apparatus for practicing the invention.
Figure 2:
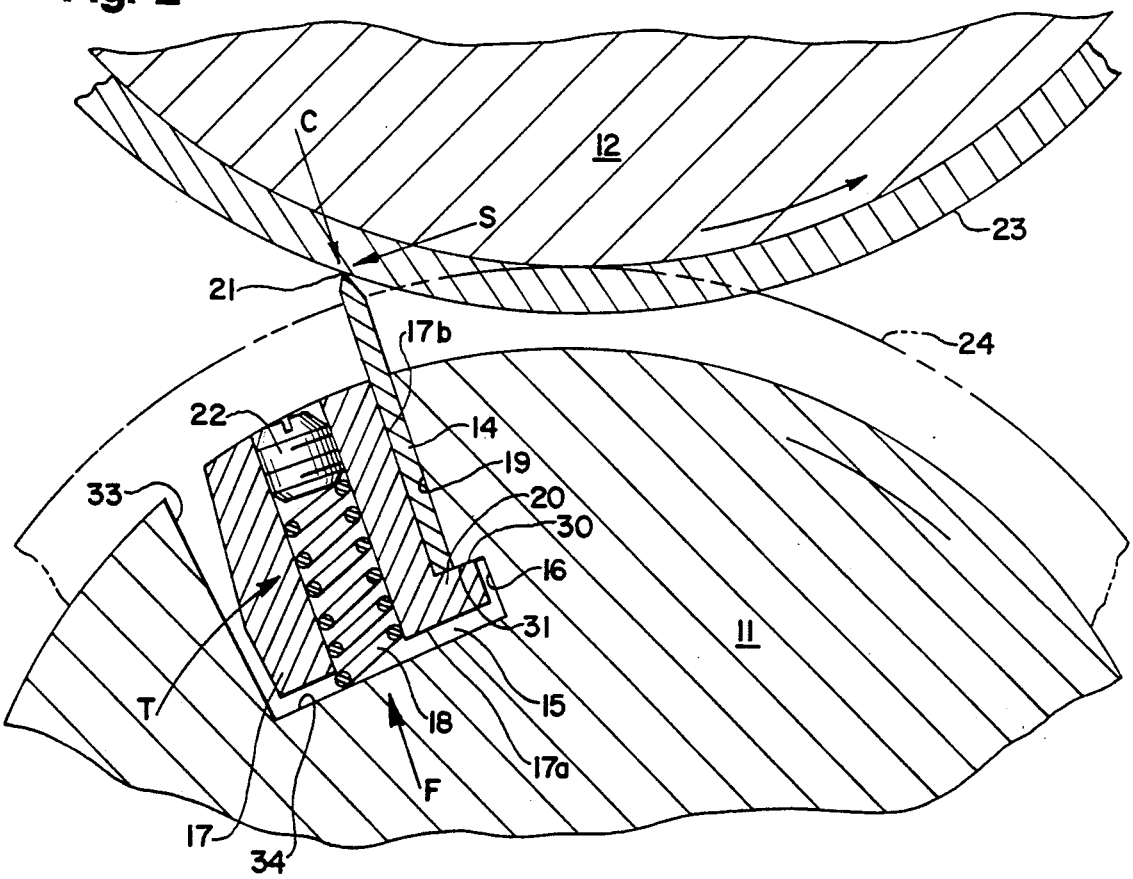
FIG. 2 is a fragmentary enlarged side elevational view of one embodiment of the blade and impression cylinders.

In FIG. 1, the numeral 10 designates generally the frame of the apparatus which rotatably supports a blade cylinder 11 and an impression cylinder 12. These are rotated by a gear train 13. The numeral 14 designates the blade carried by the blade cylinder 11. One clamping arrangement is shown in FIG. 2. A slot 15 is cut across the axial length of a rotating blade holding or carrying cylinder 11. On one side of the slot, an undercut 16 is provided. A blade clamping bar 17 is s id into slot 15 and retained therein against axial movement by bearers 17' (see FIG. 5). A series of axially spaced springs 18 apply a force F upward as illustrated, i.e., radially outward, on the bar 17. The force of these springs is in the range of 100# to 500# per inch of length of the cutting blade. A force F of 150# per inch is typical when cutting bond papers of 0.002 to 0.005 inch thickness.

The cutting or perforating blade 14 is mounted between the bar 17 and one sidewall 19 of the slot 15. The blade 14 is supported on its bottom edge by the bar 17 at ledge 20. The blade 14 is supported so that the cutting edge 21 will be moved downward against the force F of springs 18 when it contacts the anvil cylinder 12. It is desirable that the amount of downward movement be minimal but sufficient to absorb the errors due to manufacturing tolerances in the height of the cutting rules, changes in center distance due to heating of the frames, run out of the cylinders, etc. A convenient amount for this dimension is about 0.010 inch when cutting paper and plastic materials of 0.002 to 0.005 thickness. This amount can be chosen to meet the specific demands of the installation. The springs 18 are compressed during the installation of the bar 17 into the slot 15 to provide a sufficient cutting force on the blade for a particular material using screws 22. The additional compression on the springs during the actual cutting can be designed to add a very nominal amount of additional force to the highly compressed springs or, if desired, the springs can be designed to give very little force until compression during cutting takes place. The first case is preferred as the spring design is less critical.

The springs 18 shown in FIG. 2 also provide a rotational torque T to bar 17 as the thrust of springs 18 is shown to be to the left of the center of the blade 14. This torque T provides a clamping force near the top of the blade 14. A clamping force is advantageous in that it keeps the blade from falling out during rotation and it also prevents the blade from tilting away from the sidewall 19 due to cutting forces encountered from the time the blade first contacts the material until it passes over dead center. These non-radial forces are due to the thickness of the material 23 and the projection of blade 14 above the radius of cutting 24 against impression cylinder 12.

These non-radial forces are on the order of 10# per inch when using a 150# per inch cutting force, material 0.002 to 0.005 thick and a blade movement of 0.010 inch.

The spring adjusting screws 18 can be used to facilitate the installation and removal of the bar 17 from the cylinder. When the screws 18 are retracted or removed, the force F on the bar is reduced to zero thus making it convenient to slide the bar 17 in or out of the slot 15.

FIG. 2 shows the cutting blade 14 at the moment the blade first contacts the material web 23 to begin the cutting action. Blade 14 is projecting above the cutting radius 24 by about 0.010 inches. There is a radial cutting force C developed by blade 14 as it penetrates the web 23 and compresses springs 18. There are also non-radial forces S acting on the point of the blade due to the thickness of web 23 and the projection of blade 14 beyond the cutting radius 24. Only when the blade reaches top dead center are these non-radial forces reduced to zero or near zero.

The non-radial forces must be overcome or the blade 14 would tilt away from the side 19 of slot 15 causing a loss in cutting effectiveness as well as an error in the location of the cut. The non-radial force S is much less than the cutting force F and is easily resisted by the torque T developed by the spring force F acting through the distance between the center of the blade 14 and the center of springs 18.

FIG. 2 shows the direction of rotation which places the greatest burden on the blade bar 17 to resist the non-radial forces S. An opposite rotation would result in most of the resisting forces coming from the solid side 19 of the cylinder slot 15.

Figure 3:
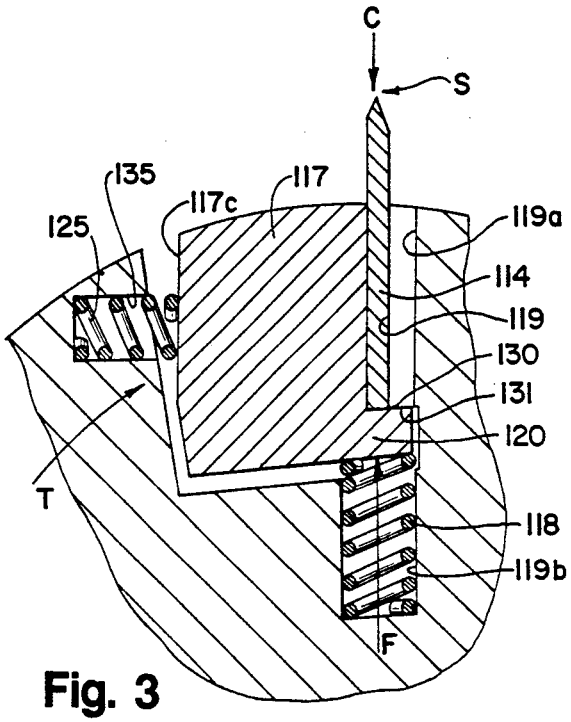
FIGS. 3 and 4 are views similar to FIG. 2 but showing other embodiments.

The side clamping force could be provided by torque T through a second series of springs 125 as shown in FIG. 3. This FIG. also shows a spring force F directly under the center or longitudinal mid-plane of blade 114 which would produce no rotational torque on the bar 117. For this mounting of spring 118, the spring receiving bore **119*b* creates a relief 119*a* in the side wall 119. This relief is small enough that it dies not affect the proper support of the blade 114 by the side wall 119**.

It is advantageous to provide side clamping of the bar 117 by action of the springs 125 because the torque T can be chosen to be the minimum necessary to hold the blade and to overcome the side cutting forces S. When the side clamping is very rigid as it is when clamped by screws, the blade is not free to move up and down at each cut in order to absorb inaccuracies in the system. Secondly, relatively light spring loading of bar 117 makes it easy to manipulate the bar to change blades.

In present practice, a bar is used to clamp the blade by friction between the adjacent slot side wall and the clamping bar. This clamping force must be substantially higher than the radial cutting force. Thus, when using steel for the blade, slot wall and clamp bar and a radial cutting force of 150 pounds per inch of blade length, the clamping force is of at least 200 pounds per inch and in actual practice much more than that in order to insure adequate clamping.

However, in any case, the non-radial force on the blade due to the thickness of the material to be cut and the amount of movement of the blade are only about 10 pounds per inch of width. Thus, when only the non-radial cutting force must be met rather than the forces required for rigid clamping, it becomes possible for the machine operator to easily manipulate the bar in order to change the blade.

Figure 5:
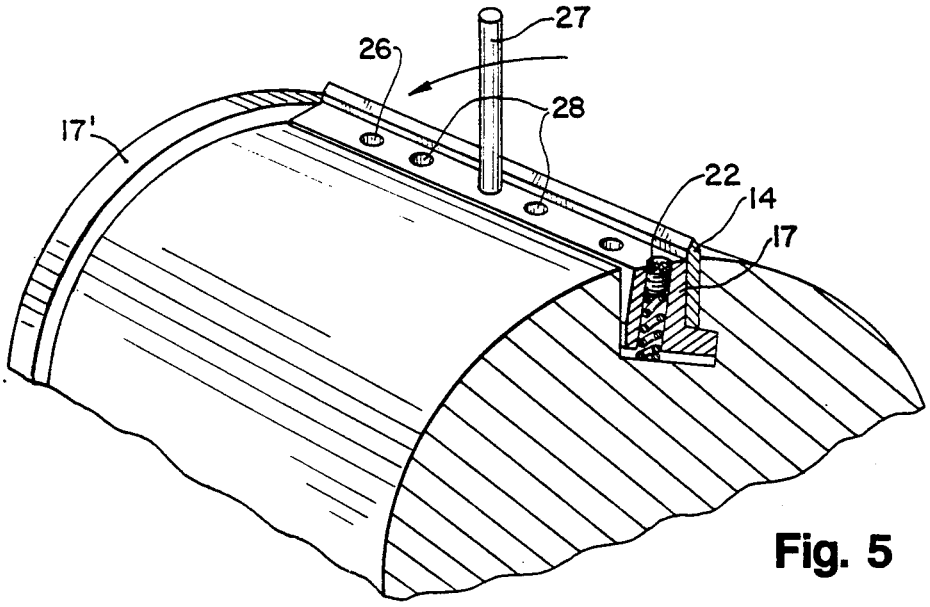
FIG. 5 is a fragmentary, perspective view of the blade roll in the process of blade changeover.

One method to remove and install blades is shown in FIG. 5. The bar 17 is provided with holes 26 in the top of the bar to accept a pin punch 27 or the like for the operator to use as a lever to open the gap and release the blade. Therefore, the blades can be changed much more quickly than when using the series of clamping screws as are now commonly used.

Figure 4:
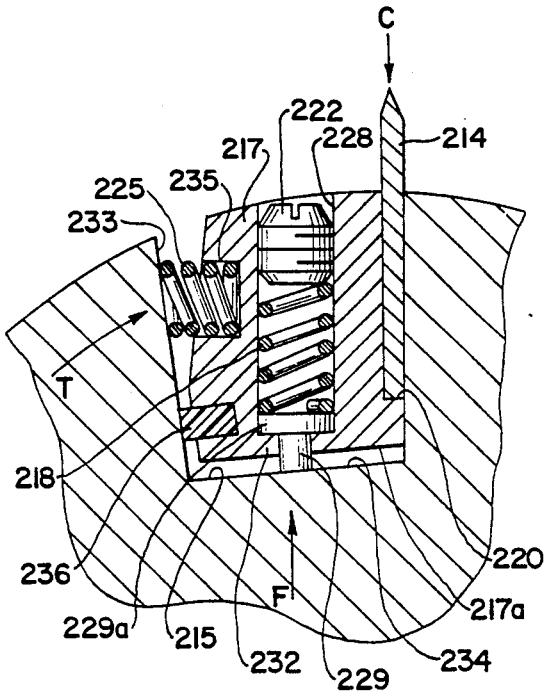

FIG. 4 shows an advantageous configuration for use in conventional slots found in existing equipment for using the conventional blade lock up arrangement with many screws. The arrangement of FIG. 4 can be used to retrofit these existing systems.

A typical slot 215 as shown in FIG. 4 is used on many existing machines. A blade clamping bar 217 fits into the slot 215 and has a blade supporting ledge 220 to support blade 214. Ba 217 has spring holes 228 (like holes 28 in FIG. 5) spaced along its length to enclose springs 218. Each spring applies a cutting force to an associated plunger 229. Each spring 218 is retained in the hole 228 by screw 222 which can also be used to adjust the initial force of the spring 218 on the plunger 229. The plunger 229 bears against the bottom of the slot 215 and provides force F to the bar 217 and thus to blade 214 sufficient to cleanly cut the web material. The blade is maintained a distance above the cutting radius of the blade cylinder such that it will be pressed down into the slot 215 a small distance as the blade contacts first the web material and an instant later the impression cylinder. As mentioned earlier, this distance can be on the order of 0.010 inches.

The force F and the force C on the cutting blade 214 are spaced apart a distance which causes a rotational torque T causing the bar 217 to clamp the bar more tightly as the blade 214 is forced down into the slot 215 during the cutting action. This blade clamping is desirable as it can be used to resist the side acting forces caused by the web thickness and blade extension as previously described. The side clamping force can be adjusted within a desirable range by choosing the dimension between lines of force F and C.

The side clamping forces just described do not exist when the blade is not cutting. Springs 225 are used to provide sufficient side clamping force to retain the blade in the slot when it is not cutting. Springs 225 advantageously provide a relatively small side clamping force to make it easy for the operator to release the blade clamping in order to change blades. The more substantial side clamping forces desired during the actual cutting are developed as previously described.

In the embodiments of FIGS. 2 and 3, the position of the blade in preparation for cutting is established by a further ledge means 30, 130 and a shoulder 31, 131 in the sidewall 19, 119 as the case may be. These elements 30, 31 or 130, 131 are bearing means operative to limit the extent to which the spring means 18, 118 are able to move the bar 17, 117 and hence blade 14, 114 radially outwardly.

In the embodiment of FIG. 4, a further ledge means is provided in the form of the constriction 232 at the inner end of each spring hole or recess 228. The head **229*a* of the plunger 229 is urged against this further ledge means 232 by each spring 218 whereby after the blade 214 is forced inwardly incident to cutting, the further ledge means 232 cooperate with the plunger head 229*a* to establish the outward position of the blade 214** for the next cutting operation.

OPERATION GENERALLY

According to the invention, the frame 10 includes horizontally spaced side frames and the usual cross tie members Rotatably supported on the frame 10 are a blade roll or cylinder 11 carrying blade 14 and an impression or anvil roll or cylinder 12. Not shown but coupled to the gear train 13 are other gears and feed rolls for advancing the web material 23 (see FIG. 2) between the rolls 11 and 12.

The blade roll 11 has an axially-extending slot 15 across the length extending generally radially inwardly from the roll periphery and defined by spaced, generally radially-extending side walls 19 and 33 (see FIG.2 ) and a generally circumferentially-extending bottom wall 34.

Mounted in the slot 15 is a blade-supporting/clamping bar 17 having its bottom or radially-inward wall **17*a* spaced from the slot bottom wall 34. The bar 17 is equipped adjacent its bottom wall 17*a* with generally radially-extending integral ledge means 20. The blade 14 is supported on the ledge means 20 and is interposed between the slot side wall 19 and the confronting bar side wall 17*b***.

In the FIG. 2 embodiment, a series of springs 18 spaced along the length of the bar 17, bearing against the slot bottom wall 34 and screws 22, exert both radial and circumferential resilient forces against the blade 14. As seen in FIG. 2, the spring axis or radial centerline is offset from the blade radial centerline to provide a couple pressing the blade 14 against the side wall 19.

The essential difference between the embodiments of FIGS. 2 and 3 lies in the provision of two series of springs in the FIG. 3 embodiment—the axis of springs 118 being aligned with the longitudinal mid-plane of the blade 114 so there is no couple to press the blade 114 against the side wall 119. To provide the circumferential force required to clamp the blade 114 against the wall 119 and oppose non-radial forces S arising from the thickness of the web 23 (see FIG. 2) and the projection of blade beyond the cutting radius 24. I provide the series of generally circumferentially-extending springs 125. These are mounted in bores 135 and bear against a generally radially-extending wall **117*c* of the bar 117**.

In both the embodiments of FIGS. 2 and 3, I provide the same bearing means for establishing the position of the blade 14, 114 in preparation for cutting. This consists of extending the previously-mentioned ledge means as at 20, 120 further generally circumferentially as at 30, 130 and providing a shoulder or undercut in the side wall 19, 119 as at 31, 131. Therefore, the spring means 18, 118 are effective to move the blade 13, 114 only a predetermined distance in the generally radially outward direction. It will be appreciated that the spring means in all of the embodiments may not only include coil springs as illustrated but other resilient force exerting means such as Belleville springs, polyurethane springs, etc. Advantageously, the spring means provide a strong force for cutting but a light force to hold the blade resulting in an easy to manipulate bar.

The FIG. 4 embodiment is intended for retrofitting existing cutting apparatus where boring or undercutting of the blade-receiving slot could be time-consuming and expensive. Here I use again two series of springs at 218 and 225—the latter being used advantageously to provide a relatively small side, i.e., generally circumferential, clamping force to retain the blade 214 in the slot 215 when the blade is not cutting. For this purpose, this second spring set 225 bears against the slot wall 233 and is received within a bore 235 in the bar 217. As with the other embodiments, this makes it easier for the operator to overcome blade clamping and change blades.

In a fashion similar to the operation of the embodiments of FIGS. 2 and 3, the force C, resulting from cutting engagement, moves the blade 214 and therefore the bar 217 generally radially inwardly—made possible by the spacing again of the bottom wall 217*a* of the bar 217 from the bottom wall 234 of the slot 215. By virtue of the engagement of the plunger 229 with the slot bottom wall 234, each spring of the set 218 is compressed. Then, when the cutting force disappears —as when the blade moves beyond over dead center—the springs elongate until the plunger head 229*a* contacts the ledge means 232 provided by a constriction in the bore 228. This, then, positions the blade 214 for the next cutting operation.

During operation, the increased side clamping force developed at each cut and the resulting and the resulting rotational torque cause the bar 217 to generate an amount of noise as it contacts wall 233 that could be objectionable in some installations. To minimize this noise, a polyurethane or other suitable material 236 can be installed in bar 217 to reduce noise to acceptable limits.

FRICTION MEANS FOR INHIBITING BLADE AXIAL MOVEMENT

Figure 6:
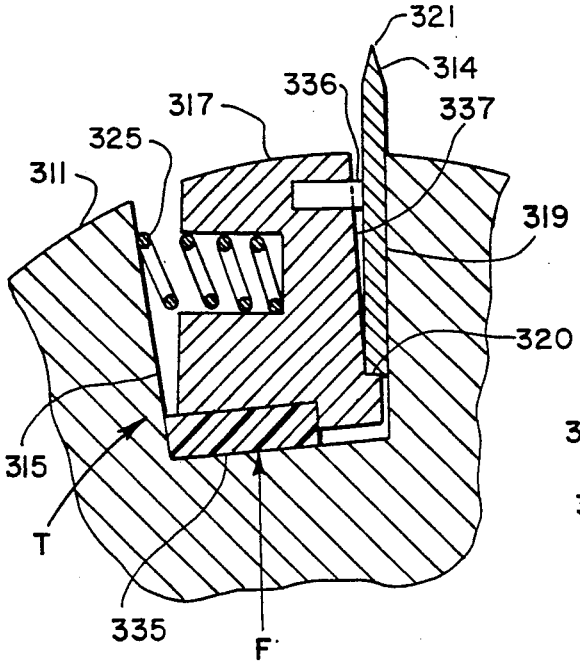
FIG. 6 is a view similar to FIGS. 3 and 4 but showing one friction means for inhibiting blade axial movement.

In FIG. 6, the blade 314 is supported on ledge 320 of blade holding bar 317. Blade holding bar is positioned in slot 315 of the blade cylinder 311. The spring pad 335 supports the bar such that the cutting edge 321 of the blade 314 is a few thousandths of an inch above the radius of cutting so that the blade and bar will be pressed downward into slot during the actual cutting operation. The downward movement of the bar 314 compresses spring pad 335 developing a force F sufficient to cut the material being processed. The cutting force also creates a tongue T that securely clamps the blade 314 against slot wall 319 during the actual cutting operation.

During the portion of the revolution of the blade cylinder 311 when cutting is not actually taking place, there is no torque T to clamp the blade against slot wall so springs 325 are provided for this purpose.

It is desirable that the clamping force provided by springs 325 be modest so the operator finds it easy to move the bar to release the blade when installing or removing the blade. Excessive spring forces can result in deformation or damage to the bar when applying sufficient force to release the blade. When no cutting action is taking place, springs 325 provide sufficient clamping torque T to prevent the blade 314 from falling out of slot 315.

Figure 7:
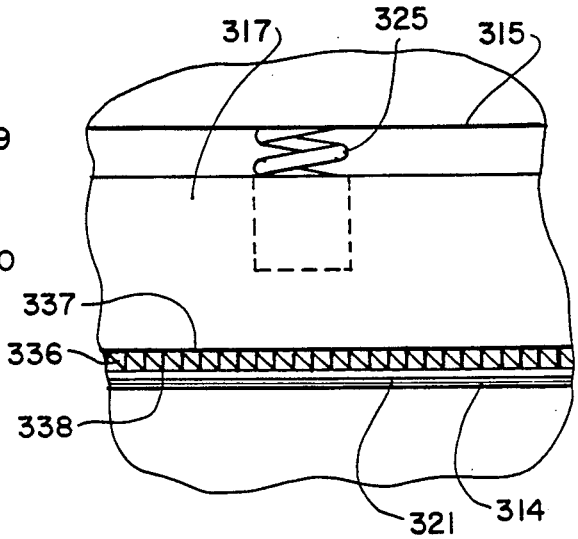
FIG. 7 is a top plan view of the embodiment of FIG. 6.

In order to restrain the blade 314 from moving across the width of the slot 315 during repeated cutting actions, I provide an inhibiting member in the form of sawtooth element 336 which projects slightly from the wall 337 of the bar 317 enabling the teeth 338 of the sawtooth element 336 to engage one side of the blade 314 (see also FIG. 7). The saw teeth have a relatively small area and are sharp enough to actually bite into the blade under the modest torque provided by springs 325. The cutting blades are usually made of steel hardened to 40 Rockwell C to about 55 Rockwell C to ensure long life.

Figure 8:
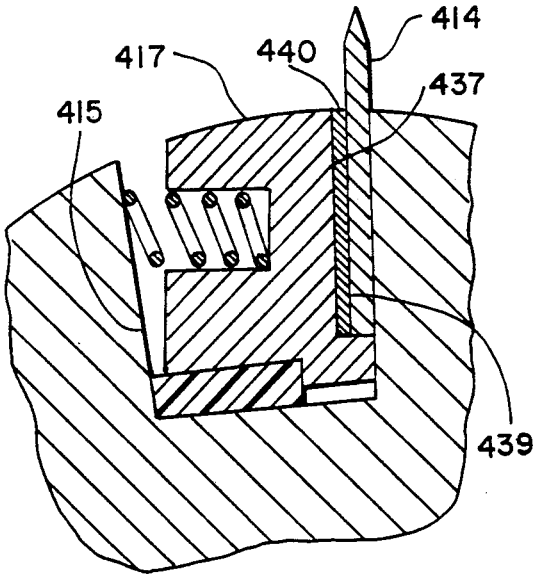
FIGS. 8 and 9 are views similar to FIG. 6 but showing other friction means for inhibiting blade axial movement.

FIG. 8 shows a similar arrangement to FIG. 6 except that in place of the sawtooth element 336 of FIG. 6, there is provided a high friction surface 439 to grip the blade 414 to restrain the blade from side-to-side movement in slot 415. This surface 439 advantageously can be an abrasive material such as aluminum oxide, silicon carbide, or the like, typically ranging from 36 to 240 in grit size. Also employed to advantage are other high friction materials such as plasma coated tungsten carbide.

Figure 9:
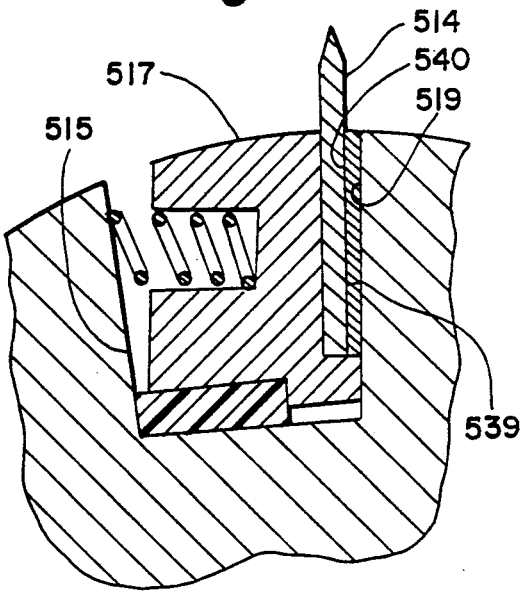

The high friction surface 439, 539 can be located on wall 437 in FIG. 8 or the wall 519 of FIG. 9 with equal effectiveness. Alternatively, the high friction surface 439, 539 can be located on a member 440 intermediate the blade 414 and the bar 417 or a member 540 intermediate the blade 514 and the cylinder wall 519. A particularly advantageous intermediate member is an element constructed of approximately 0.010" spring steel coated as mentioned above and having opposed generally planar surfaces.

FIG. 9 shows an intermediate member 540 located between cylinder wall 519 and cutting blade 514. Member 540 has a high friction surface 539 on at least the surface facing blade 514. The other surface of member 540 could also have a high friction surface facing cylinder wall 519. The same arrangement applies to the member 440 of FIG. 8 in its position against the adjacent wall 437 of the bar 417.

In the instance of friction coating both surfaces of the intermediate member 440, 540 no additional axial inhibiting means is required. The same applies if one of the two friction coated surfaces is the bar wall 437 or the cylinder wall 519. Also, it is advantageous to adhere the member to the adjacent cylinder or bar wall.

In actual practice, the invention will be used with cylinders in the field which are difficult to coat. Although the coating can be applied to the bar with less difficulty, it is sometime advantageous to have the coating on an easily replaceable, inexpensive member. In such a case, the coating may be only on one surface of the member 440, 540 and the member itself restrained against axial movement by the usual means at the ends of the slot such as bearers or bar retainers well known in the art which so limit the bar or other holder means for the blade. It will be appreciated that the blades are typically shorter than the slot, hence the need for inhibiting axial movement.

While in the foregoing specification a detailed description of the invention has been set down for the purpose of illustration, many variations in the details hereingiven may be made without departing from the spirit and scope of the claims.

I claim:

1. Apparatus for cutting web material comprising a frame, a blade roll rotatably mounted on said frame, an impression roll rotatably mounted on said frame adjacent said blade roll, said blade roll being equipped with an axially-extending slot having a radially inward generally circumferentially-extending bottom wall spaced generally radially-extending side walls, a blade-supporting bar mounted in said slot having a bottom wall adjacent from said slot bottom wall, said bar being equipped with generally circumferentially-extending integral ledge means adjacent said bar bottom wall, a blade mounted on said ledge means and interposed between said bar and one sidewall of said slot, and spring means operatively associated with said blade roll bearing against said bar for exerting both generally radial nd circumferential forces against said bar to clamp said blade while providing a radially resilient mounting for said blade during cutting, but when not cutting, said spring means providing only about sufficient clamping torque to present said blade from falling out of said slot, and friction means operably associated with said blade for inhibiting axial movement of said blade.

2. The apparatus of claim 1 in which said friction means includes a member interposed between said blade and one of said bar and said one sidewall of said slot.

3. The apparatus of claim 2 in which said member is a sawtooth element mounted in said bar and bearing against said blade.

4. The apparatus of claim 2 in which said member is an elongated element having at least one high friction surface, said one surface being in confronting relation to said blade.

5. The apparatus of claim 4 in which said element has a pair of opposed generally planar surfaces, the other of said surfaces being in confronting relation to a sidewall on one of said bar and said slot.

6. The apparatus of claim 5 in which said other surface is adhered to said sidewall on one of said bar and said slot.

7. The apparatus of claim 5 in which one of said other surface and said sidewall on one of said bar and said slot is equipped with high friction material.

8. The apparatus of claim 4 in which member restraining means are provided at the ends of said slot.

9. Apparatus for cutting web material comprising a frame, a blade roll rotatably mounted on said frame, an impression roll rotatably mounted on said frame adjacent said blade roll, said blade roll being equipped with an axially-extending slot having a radially inward generally circumferentially-extending bottom wall and spaced generally radially-extending side walls, a blade-supporting bar mounted in said slot having a bottom wall adjacent from said slot bottom wall, said bar being equipped with generally circumferentially-extending integral ledge means adjacent said bar bottom wall, a blade mounted on said ledge means and interposed between said bar and one sidewall of said slot, and spring means operatively associated with said blade roll bearing against said bar for exerting both generally radial and circumferential forces against said bar to clamp said blade while providing a radially resilient mounting for said blade during cutting but when not cutting, said spring means providing only about sufficient clamping torque to present said blade from falling out of said slot, and friction means operably associated with said blade for inhibiting axial movement of said blade, said friction means including a high friction surface on said one sidewall of side slot.

10. Apparatus for cutting web material comprising a frame, a blade roll rotatably mounted on said frame, an impression roll rotatably mounted on said frame adjacent said blade roll, said blade roll being equipped with an axially-extending slot having a radially inward generally circumferentially-extending bottom wall and spaced generally radially-extending side walls, a blade-supporting bar mounted in said slot having a bottom wall adjacent from said slot bottom wall, said bar being equipped with generally circumferentially-extending integral ledge means adjacent said bar bottom wall, a blade mounted on said ledge means and interposed between said bar and one sidewall of said slot, and spring means operatively associated with said blade roll bearing against said bar for exerting both generally radial and circumferential forces against said bar to clamp said blade while providing a radially resilient mounting for said blade during cutting but when not cutting, said spring means providing only about sufficient clamping torque to prevent said blade from falling out of said slot, and friction means operably associated with said blade for inhibiting axial movement of said blade, said bar having a wall in confronting relation to said blade, said friction means including a high friction surface on said bar confronting wall.

11. Apparatus for cutting web material comprising a frame, a blade roll rotatably mounted on said frame, an impression roll rotatably mounted on said frame adjacent said blade roll, said blade roll being equipped with an axially-extending slot having a radially inward generally circumferentially-extending bottom wall and spaced generally radially-extending side walls, a blade-supporting bar mounted in said sloth having a bottom wall adjacent from said slot bottom wall, said bar being equipped with generally circumferentially-extending integral ledge means adjacent said bar bottom wall, a blade mounted on said ledge means and interposed between said bar and one sidewall of said slot, and spring means operatively associated with said blade roll bearing against said bar for exerting both generally radial and circumferential forces against said bar to clamp said blade during cutting, but when not cutting, said spring means providing only abut sufficient clamping torque to prevent said blade from falling out of said slot, and friction means operably associated with said blade for inhibiting axial movement of said blade, said friction means being harder than said blade to bitingly engage said blade.

* * * * *